United States Patent [19]

Wiech, Jr.

[11] 4,404,166

[45] Sep. 13, 1983

[54] METHOD FOR REMOVING BINDER FROM A GREEN BODY

[75] Inventor: Raymond E. Wiech, Jr., San Diego, Calif.

[73] Assignee: Witec Cayman Patents, Limited, Cayman Islands, Cayman Islands

[21] Appl. No.: 227,271

[22] Filed: Jan. 22, 1981

[51] Int. Cl.[3] ..... B22F 3/00

[52] U.S. Cl. ..... 419/36; 264/42; 264/63; 264/65; 419/37; 419/44

[58] Field of Search ..... 75/211; 203/4; 264/42, 264/63, 65, 66; 419/36, 37, 44

[56] References Cited

U.S. PATENT DOCUMENTS

| | | | |
|---|---|---|---|
| 2,939,199 | 6/1960 | Strivens | 264/101 |
| 3,496,068 | 2/1970 | Plant | 203/4 |
| 3,809,553 | 5/1974 | Peaslee | 75/211 |
| 3,811,878 | 5/1974 | Chao et al. | 75/211 |
| 3,992,200 | 11/1976 | Chandhok | 75/211 |
| 4,011,291 | 3/1977 | Curry | 264/86 |
| 4,113,480 | 9/1978 | Rivers | 75/211 |
| 4,209,326 | 6/1980 | Klein et al. | 75/211 |
| 4,259,112 | 3/1981 | Dolowy et al. | 75/211 |

*Primary Examiner*—Edward J. Meros
*Assistant Examiner*—Wayne A. Langel
*Attorney, Agent, or Firm*—Jay M. Cantor

[57] ABSTRACT

A method and system whereby binder can be removed from a green body much more rapidly than in prior art systems without interfering with the integrity or aesthetics of the final part by providing a binder system having at least two components and preferably a mold release agent, the binder system having differing melting points. Each binder component can have parts with different melting temperature. When the temperature is raised to a point above the intermediate temperature at which the binder system flows, binder will proceed to exude to the surface of the green body wherefrom it can be removed.

The binder is removed from the surface of the green body by blowing a non-saturated chemically inert atmosphere over the surface of the green body rapidly whereby the atmosphere at a region near the surface of the green body does not become saturated with the binder vapors. As an alternative, the green body can be placed on a wick with the air being blown rapidly over the surface of the green body as well as the wick itself to volatilize the binder and remove same from both the wick and the green body. As binder is removed from the green body, since only the lower melting point component binder is actually volatilized initially, the melting point of the binder system within the green body gradually increases since more of the higher melting point component binder remains behind. For this reason, the temperature within the system is continually raised to above the then system flow temperature and below the melting point of the highest melting binder component. In this way, the highest melting point binder component continues to provide rigidity to the green body and prevent collapse or shape alteration thereof.

16 Claims, 1 Drawing Figure

METHOD FOR REMOVING BINDER FROM A GREEN BODY

BACKGROUND OF THE INVENTION

1. Field of the Invention

This invention relates to the formation of parts from particles of material and, more specifically, to a method of removing binder from the green body formed in the process of formation of such parts.

2. Description of the Prior Art

The art of forming articles from particulate material is well known and examples of such systems are represented in the U.S. patents of Strivens No. 2,939,199, Wiech No. 4,197,116, British Pat. Nos. 779,242 and 1,516,079, Curry No. 4,011,291 as well as the application of Wiech, Ser. No. 111,632, filed Jan. 14, 1980. While these prior art systems represent the gradual evolution in the art of manufacturing parts from particulate material with binder removal, the prior art has always suffered with the problem that the time required to remove the binder from the green body has been lengthy. Though this time period has been gradually shortened with developments in the art, it is always desirable to maximize and improve the time period required for such binder removal without damaging or otherwise imparing the integrity or aesthetics of the part being manufactured.

BRIEF DESCRIPTION OF THE INVENTION

In accordance with the present invention, the above noted problems of the prior art are overcome and there is provided a method and system whereby binder can be removed from a green body much more rapidly than in prior art systems without in any way interfering with the integrity or aesthetics of the final part. Briefly, this is accomplished by providing a binder system having at least two components and preferably a mold release agent, the binder system compounds having differing melting points. Each binder component can have parts with different melting temperatures as in the case of carnauba wax. It has been found that, in the case of such binder system, the binder system complex has a flow or melting point somewhere between the melting points of the highest and lowest binder components. Furthermore, when the temperature is raised to a point above the intermediate temperature at which the binder system flows or melts, binder will proceed to exude to the surface of the green body wherefrom it can be removed.

In accordance with the present invention, the binder is removed from the surface of the green body at such elevated temperatures by blowing a non-saturated atmosphere over the surface of the green body rapidly whereby the atmosphere at a region near the surface of the green body does not become saturated with the binder vapors. As an alternative, the green body can be placed on a wicking agent in the manner set forth in the above noted Wiech application with the air being blown rapidly over the surface of the green body as well as the wick itself to volatilize the binder and remove same from both the wick and the green body. Though the wick itself has great drawing power for the binder material as noted in the prior art, it has now been found that when the binder material comes to the surface of the green body and is then removed, such removal has a drawing effect wherein much binder is pulled to the surface of the green body for further evaporation and removal. As binder is removed from the green body, since only the lower melting point component binder is actually volatilized initially, the melting point of the binder system within the green body will gradually increase, since more of the higher melting point component binder remains behind. For this reason, the temperature within the system can continually be raised to above the then system flow or melting point as long as it is maintained below the melting point of the highest melting point binder component. In this way, the highest melting point binder component continues to provide rigidity to the green body and prevent collapse or shape alteration thereof.

A typical preferred binder would include anywhere from 5 to 50% by weight polypropylene which goes from the crystalline to the liquid state at about 170° C. with 20% binder being a preferred amount. Carnauba wax with a melting point about 85° C. which would be about 10% by weight, the carnauba wax providing a mold release agent function in addition to the binder function and paraffin with a melting point of about 50° C. which would make up the rest of the binder system. It should be understood that other appropriate binder materials can be used as long as they have the properties set forth above for the described binder system. These will not be set forth since they are all well known and numerous.

When heated, the paraffin will initially flow through the molecular interstices of the polypropylene to the surface of the green body for evaporation. As stated above, the polypropylene itself will remain in the green body until all of the paraffin and carnauba wax have been removed and the temperature then raised to a point above the melting point of the polypropylene. At this point, the green body appears to lock in place, even without a binder, and the temperature can then be raised to sintering temperature for the particulate material being used with the atmosphere being appropriate for the material being used to provide the sintering function in accordance with the prior art.

DESCRIPTION OF THE DRAWING

The FIGURE describes schematically a binder removal system in accordance with the present invention.

DETAILED DESCRIPTION OF THE INVENTION

Figure 1:
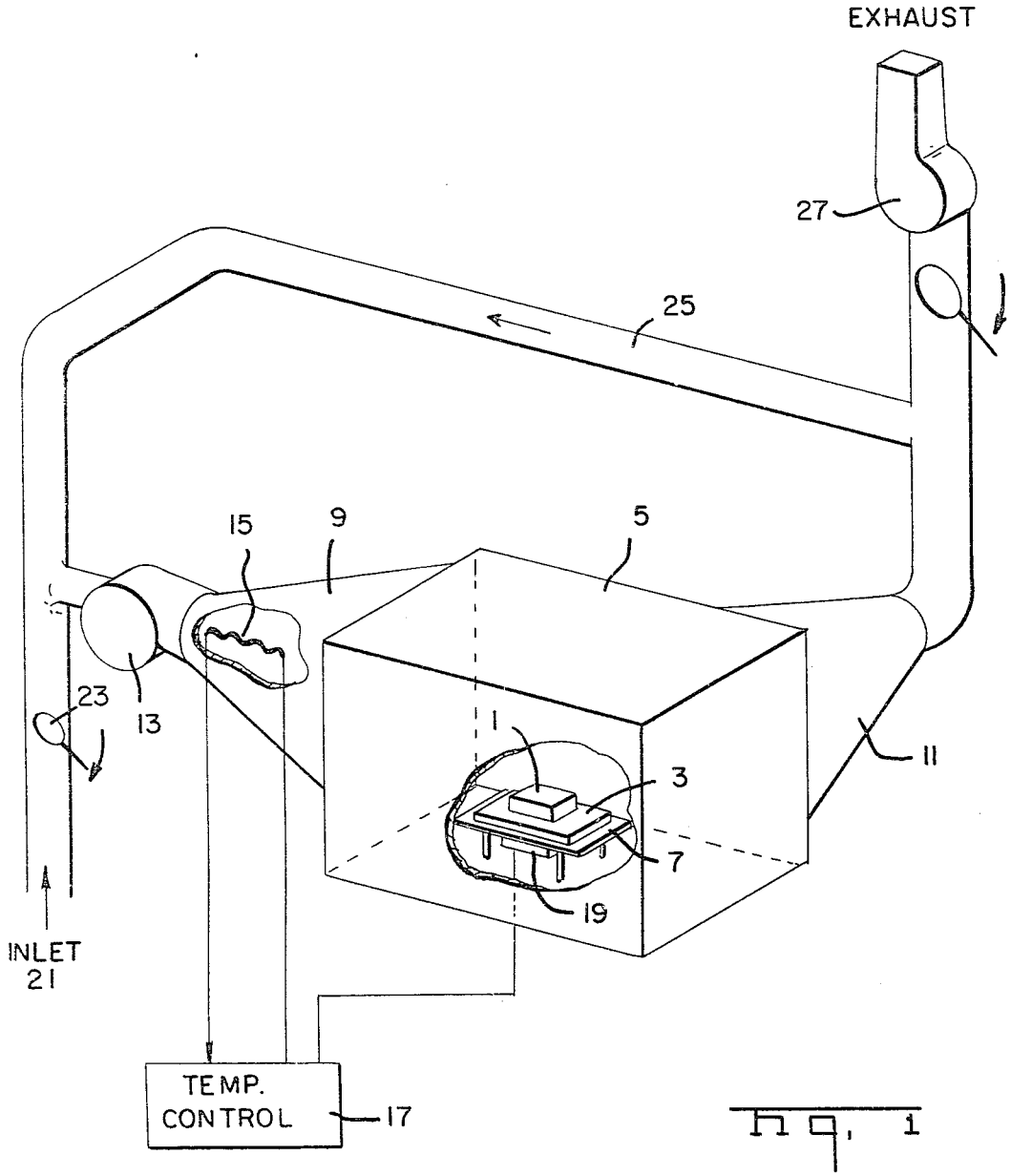

Referring now to the FIGURE, it should first be understood that green bodies are formed in accordance with the prior art as set forth in the above described patents and application or otherwise, these green bodies then requiring removal of the binder.

As can be seen with reference to the FIGURE, a green body 1 is placed on a wick 3 in an oven 5, the wick being positioned on a support table 7 within the oven. The wick 3 may be permeable to permit evaporation from all surfaces thereof. The oven has an air inlet port 9 and an exhaust port 11. A blower 13 is positioned at the entrance to the inlet port 9 and blows unsaturated atmosphere over a heater 15 which is controlled by a temperature controller 17 to provide proper heating within the oven. The temperature controller 17 can also be responsive to a further temperature device 19 positioned within the oven and closely adjacent the green body 1 to insure that the temperature of the green body is at the desired level.

Unsaturated air or other appropriate atmospheres will enter the system by the inlet 21 through a valve 23 which controls the amounts of inlet air and then travel to the blower 13 which blows the air over the heater 15 into the oven 5 to maintain the desired oven temperature and over the green body and wick. The air from the oven with binder vapors therein then exits from the oven through the exhaust port 11 and all or part of this exhaust air is recirculated through the recirculating air line 25 to mix with inlet air and part of the exhaust air is transferred by means of a blower 27 to the exhaust external of the system. The exhausted air with binder vapors therein can either be exhausted to the atmosphere or can be condensed in a proper condenser by lowering the temperature thereof whereby the binder vapors can be condensed and recovered for reuse.

The blower 13 is designed to blow air at a rapid rate over the green body 1, this rate being such that the atmosphere adjacent to and in contact with the green body 1 is always maintained in an unsaturated condition so that binder will always be exuding from the interior of the green body to the surface for further evaporation. Binder will also be drawn into the wicking agent 3 and this binder material will also be vaporized due to rapid movement of the air from the blower over the wick. This rapid removal of binder from the wicking agent will also enhance the speed of removal of binder from the green body via the wicking agent.

The binder can be removed by evaporation within the wick, though it is best to use the combination of the wick and evaporation from the wick and green body surface to improve the speeed of binder removal.

The combination of use of a wick plus evaporation with high velocity air being directed at both the surface of the green body as well as the wick is extremely important, the air velocity being dependent upon the part itself and being high enough so that the atmosphere at the surface of the wick and the green body is always maintained in a non-saturated condition. The atmosphere is always moving at a high velocity for this reason to provide a turbulent flow at the part surface. In this way, the boundary layer at the surface of the green body is broken down. There is, of course, a limit to the speed of binder travel to the surface of the green body and therefore the rate of binder removal of evaporation has an upper limit. Also, the speed of the air over the surface of the green body and the wick also will ultimately reach an upper limit whereby increased speed will no longer provide increased speed of removal of binder.

A binder vapor sensor of known type (not shown) can be placed in the exhaust port 11 or elsewhere in the exhaust portion of the system to measure the degree to which the atmosphere has been saturated with binder. This measurement can be used to control the inlet valve 23 and the exhaust valve 24, whereby atmosphere is allowed to flow to the exhaust when complete saturation approaches with concommitant replacement of the exhausted atmosphere with inlet unsaturated atmosphere.

In a system utilizing about 20% polypropylene, 10% carnauba wax and the rest paraffin, the binder system flow point is approximately 125° C. Therefore, in order to obtain flow of the binder system, it is merely necessary to raise the temperature of the binder from about 110° C. up gradually, noting when the surface of the part goes from a damp to a dry state. The temperature is then continually increased and, as a binder is removed, the portion of binder being removed being the paraffin initially and then the carnauba wax, the system temperature melting point will be increased and the temperature of the binder will therefore increase to the flow temperature of the binder system or slightly thereabove. It is important that the vapor pressure of the low melting point component of the binder become substantial at temperatures below the melting point of the binder mixture snd this, of course, provides a limitation upon the binder system. When all of the binder system except the polypropylene has been removed, the body will be porous because about 80% of the binder has been removed. The body will then contract due to the space formed by the binder removal and the desire of the molecules to come together. Also, at this point, a peculiar phenomenum comes into play wherein the particulate material system appears to lock up and the green body will retain its shape without the binder for support. At this point the temperature of the system can be raised to sintering temperature for removal of the remainder of the binder by charring an oxidation and further sintering of the particles of particulate material in the manner above described in the above noted prior art.

EXAMPLE I

Three hundred fifteen grams of substantially spherical nickel particulate material having an average particle size of four to seven microns and a specific surface area of 0.34 square meters per gram (Inco type 123 nickel powder) was mixed with 35.2 grams of binder which included 7.0 grams of polypropylene which goes from the crystalline to the liquid state at about 150° C., 3.5 grams of carnauba wax having a melting point about 85° C. and 24.7 grams of paraffin having a melting point of about 50° C. The mixture was placed in a Hobart laboratory type mixer of 5 quart capacity and mixed at a temperature of 170° C. until the polypropylene incorporated itself into the mixture. The temperature was then lowered to 150° C. for ½ hour while still mixing. A hpmogeneous, uniform and modest viscosity plastisole was formed. It was removed from the mixer, allowed to cool for an hour until the binder system had solidified. The hardened material was broken up by a plastic grinder and the pieces were placed into an injection molding machine of one-half ounce capacity. Several dozen rings were formed in the injection molding machine. Three at random were removed from this batch and placed in a laboratory oven on laboratory filter paper, the oven having the configuration as shown in the FIGURE and the temperature was rapidly raised from ambient temperature to the melting point of the binder system (118° C.) over a period of nine minutes with an atmosphere of air being injected at the inlet 21. The temperature over the next two (2) hours was raised to 220° C. linearly. The temperature was then raised in the course of the next 12 hours from 220° C. to 700° F. in a substantially linear manner during which time the atmosphere was changed from air to pure argon. At 700° F. hydrogen is introduced to provide and maintain an atmosphere which is 90% argon and 10% hydrogen. The temperature was then raised to 1300° F. and maintained for two hours and then raised to a temperature of 2150° F. over a course of 6 hours in a linear manner. This temperature was maintained for one hour and the kiln was shut off and allowed to cool to substantially room temperature. The three rings were removed from the kiln and weighed and placed in a pycnometer and the density of each of the rings was determined to be 0.54 grams/cc. A metallographic section of one specimen was then made, embedded in bakelite, polished and etched as to ASTM specification and then placed under a microscope. Spherical inclusion were noted substantially homogeneously distributed through the sample. The inclusions were much smaller than the crystal size and had a very slight tendency to be located along crystal boundaries. The general appearance was that of foreign material with randomly distributed minute spherical inclusions. The second ring that was removed from the kiln was measured and found to have an outside diameter of 0.890 to 0.886 inches since a perfect circle was not obtained. The second ring was then placed in the circular die of diameter 0.885 inches and forced through the die by the arbor press. The ring was measured and found to have a substantially uniform diameter of 0.886 inches. That portion of the ring that was forced through the die was bright and shiny in appearance. As measured by a pycnometer, the density was found to be 8.65 after having made a weight check. The weight of the part was found to remain substantially constant. A metallographic section was made of the second ring in the manner described above. It was found that the uniform spherical inclusion structure had been altered by the compression of the outer circumference of the ring so that the outermost inclusions having compressed into an oblate shape with major axis about the same as the diameter of the sphere and the minor axis lying along the plate of the radius of the ring. The spherical inclusions along the inner diameter of the ring were found to be relatively unchanged.

EXAMPLE II

A run was made exactly the same as in Example I with exactly the same equipment with the particulate material being changed from nickel to substantially spherical iron of average particle diameter of 4 to 6 microns of substantially spherical shape. In this same example 278.19 grams of iron were mixed with a binder system in the same amounts as in Example I. The same testing procedure as set forth in Example I was utilized and the results were substantially identical to those listed in Example I except that the density of the rings removed from the kiln were approximately 7.46. The same results as in Example I were obtained after compression of the rings in a die in an arbor press.

EXAMPLE III

A further run was made using exactly the same procedure as set forth in Example I except that a mixture of nickel and iron was substituted for the nickel alone. 50% of the weight of nickel as set forth in Example I and 50% of the weight of iron as set forth in Example II were utilized and mixed with the 35.2 grams of the binder system of Example I. The results were exactly as set forth above with reference to Example I. The density of the rings after removal from the kiln was not measured specifically but the volume was found to have decreased after removal from the die. The weight of the body after sintering and after removal from the die was substantially the same. The article was observed during the metallographic observation under the microscope was noted to be a true alloy rather than isolated regions of nickel and iron.

EXAMPLE IV 185.3 grams of $Fe_2O_3$ of particle size less than 1 micron (of the type used for making magnetic tape as is well known) was mixed with 35.2 grams of the same binder system as in Example I and then operated on as set forth in Example I. The ring was molded as in Example I and binder finally removed in the same manner as set forth in Example I, except that the firing schedule in the atmospheric kiln was not the same and the hydrogen was continually flowed through the sintering region of the oven to maintain a reducing atmosphere therein. The temperature was raised from 150° C. to 700° F. in about 30 minutes and thereafter there was no difference in the firing schedule as set forth in Example I. The iron oxide was found to be reduced to metallic iron by the hydrogen component of the sintering atmosphere. There was also found to be a substantial decrease in volume of the ring during sintering. When the sintered pieces that were left were measured with a pycnometer, before and after hitting with a hammer, it was determined qualitatively that crushing took place. It was also found quantitatively in the pycnometer that density increased. The important feature in this example if that the $Fe_2O_3$ is a brittle material and so the starting material is brittle and does not have ductility at any time whereas the sintered material evolved did have ductility.

Though the invention has been described with respect to specifically preferred embodiments thereof, many variations and modifications will immediately become apparent to those skilled in the art. It is therefore the intention that the appended claims be interpreted as broadly as possible in view of the prior art to include all such variations and modifications.

I claim:

1. A method of producing an article from a fired particulate configuration whereby binder material is removed from the particulate configuration prior to firing without swelling the particulate configuration and consequent imparting of sheer or tensile force to the particulate configuration prior to the firing thereof, comprising the steps of:

(1) mixing together predetermined amounts of sinterable particulate material and binder whereby the binder covers substantially all of the surface of the particles of said particulate material, (2) forming said mixture from (1) into a desired configuration, (3) heating said configuration to a temperature above the flow point of said binder, (4) blowing a non-saturated, chemically inert atmosphere over said configuration at sufficient flow rate to cause atmosphere at the surface of said configuration to be turbulent and unsaturated to remove a predetermined amount of binder therefrom, (5) removing said atmosphere in (4) from the vicinity of said configuration, and (6) sintering said stripped and formed configuration from (4).

2. A method as set forth in claim 1 wherein said particulate material is taken from the class consisting of metals, ceramics and cermets.

3. A method as set forth in claim 1 further including the steps of placing a small selected area of said configuration in (2) in intimate contact with an absorbing body capable of absorbing said binder and allowing said binder to flow from said configuration into said absorbing body.

4. A method as set forth in claim 2 further including the step of placing a small selected areas of said configuration in (2) in intimate contact with an absorbing body capable of absorbing said binder and allowing said binder to flow from said configuration into said absorbing body.

5. A method as set forth in claim 3 further including blowing said atmosphere over said absorbing body to remove binder therefrom.

6. A method as set forth in claim 4 further including blowing said atmosphere over said absorbing body to remove binder therefrom.

7. A method as set forth in claim 1 wherein said binder includes plural components, each component having a different melting point.

8. A method as set forth in claim 3 wherein said binder includes plural components, each component having a different melting point.

9. A method as set forth in claim 4 wherein said binder includes plural components, each component having a different melting point.

10. A method as set forth in claim 5 wherein said binder includes plural components, each component having a different melting point.

11. A method as set forth in claim 6 wherein said binder includes plural components, each component having a different melting point.

12. A method as set forth in claim 7 wherein said step of heating includes the steps of initially heating said binder to the flow temperature thereof, then gradually raising the temperature of said binder to a point below the melting point of the highest melting point binder component while maintaining said temperature above the binder flow temperature.

13. A method as set forth in claim 8 wherein said step of heating including the steps of initially heating said binder to the flow temperature thereof, then gradually raising the temperature of said binder to a point below the melting point of the highest melting point binder component while maintaining said temperature above the binder flow temperature.

14. A method as set forth in claim 9 wherein said step of heating includes the steps of initially heating said binder to the flow temperature thereof, then gradually raising the temperature of said binder to a point below the melting point of the highest melting point binder component while maintaining said temperature above the binder flow temperature.

15. A method as set forth in claim 10 wherein said step of heating includes the steps of initially heating said binder to the flow temperature thereof, then gradually raising the temperature of said binder to a point below the melting point of the highest melting point binder component while maintaining said temperature above the binder flow temperature.

16. A method as set forth in claim 11 wherein said step of heating includes the steps of initially heating said binder to the flow temperature thereof, then gradually raising the temperature of said binder to a point below the melting point of the highest melting point binder component while maintaining said temperature above the binder flow temperature.

* * * * *